US010065102B2

(12) United States Patent
Reguis et al.

(10) Patent No.: US 10,065,102 B2
(45) Date of Patent: Sep. 4, 2018

(54) SLIDING BOARD, FASTENING DEVICE FOR SHOES AND A SNOWBOARD EQUIPMENT COMPRISING SAID SLIDING BOARD AND SAID FASTENING DEVICE

(71) Applicant: Skis Rossignol—Club Rossignol, Saint-Jean-de-Moirans (FR)

(72) Inventors: Adrien Reguis, Grenoble (FR); Vincent Gelin, Grenoble (FR)

(73) Assignee: Skis Rossignol—Club Rossignol, Saint-Jean-de-Moirans (FR)

( * ) Notice: Subject to any disclaimer, the term of this patent is extended or adjusted under 35 U.S.C. 154(b) by 0 days.

(21) Appl. No.: 15/486,805

(22) Filed: Apr. 13, 2017

(65) Prior Publication Data

US 2017/0296906 A1 Oct. 19, 2017

(30) Foreign Application Priority Data

Apr. 15, 2016 (FR) ..... 16 53380

(51) Int. Cl.
*A63C 10/18* (2012.01)
*A63C 5/04* (2006.01)

(52) U.S. Cl.
CPC ..... *A63C 10/18* (2013.01); *A63C 5/04* (2013.01)

(58) Field of Classification Search
CPC ..... A63C 10/16; A63C 10/18; A63C 5/04; A63C 5/0422
USPC ..... 280/14.22, 14.24, 626, 618
See application file for complete search history.

(56) References Cited

U.S. PATENT DOCUMENTS

| | | | | |
|---|---|---|---|---|
| 4,403,785 | A * | 9/1983 | Hottel | B63B 35/812 280/14.23 |
| 4,871,337 | A * | 10/1989 | Harris | A63C 5/003 280/14.24 |
| 6,089,581 | A * | 7/2000 | Partridge | A63C 10/20 280/14.24 |
| 6,189,899 | B1 | 2/2001 | Carlson | |
| 6,428,032 | B1 * | 8/2002 | Humbel | A63C 10/08 280/14.22 |
| 7,448,641 | B2 * | 11/2008 | Buquet | A63C 9/005 280/607 |
| 8,182,269 | B2 * | 5/2012 | Rancon | A63C 5/003 280/626 |
| 9,364,739 | B2 | 6/2016 | Reguis et al. | |
| 2003/0116931 | A1 * | 6/2003 | Quattro | A63C 5/128 280/14.21 |

FOREIGN PATENT DOCUMENTS

| | | |
|---|---|---|
| DE | 19633536 A1 | 2/1998 |
| EP | 2 644 234 A1 | 10/2013 |

* cited by examiner

*Primary Examiner* — John D Walters
(74) *Attorney, Agent, or Firm* — McCarter & English, LLP

(57) ABSTRACT

The present invention relates to, a sliding board, the structure of which comprises at least one lower layer, at least one upper layer, a core, at least one rail delimiting a groove with a top opening for receiving and guiding an anchoring component for a shoe fastening baseplate, wherein it comprises at least one serrated bar separate and spaced apart from the groove of the rail and designed to interact with at least one peripheral toothed sector mounted on the lower surface of the baseplate with a view to preventing its longitudinal translational movement, and to, a fastening device designed to equip said sliding board and a snowboard equipment comprising said sliding board and said device.

24 Claims, 5 Drawing Sheets

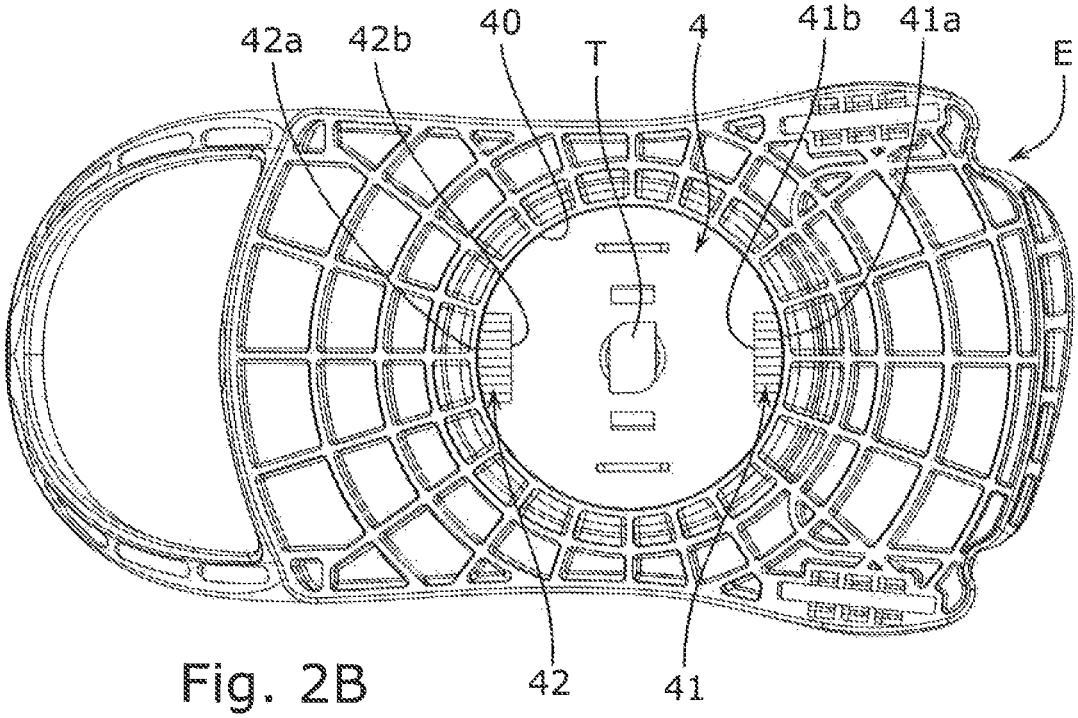
Fig. 2B
Fig. 2C
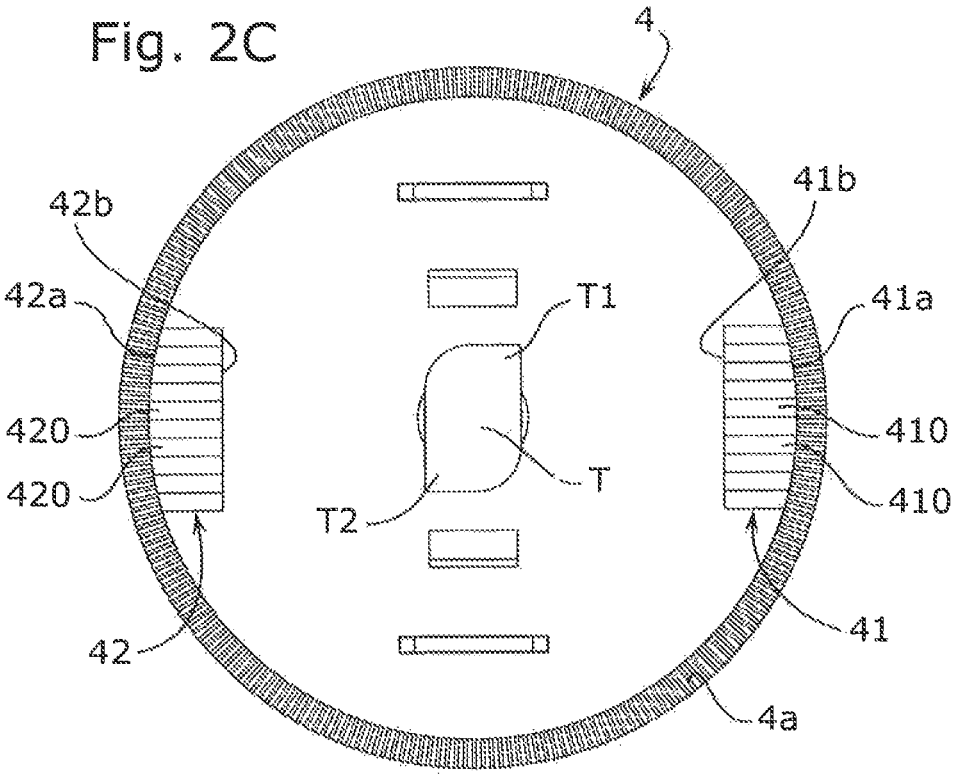

SLIDING BOARD, FASTENING DEVICE FOR SHOES AND A SNOWBOARD EQUIPMENT COMPRISING SAID SLIDING BOARD AND SAID FASTENING DEVICE

The present invention concerns a sliding board, a fastening device for shoes and a snowboard equipment comprising said sliding board and said fastening device.

More precisely, the invention relates to a sliding board equipped with an anchoring rail designed to ensure linking and locking of a specific baseplate for receiving and fastening shoes.

More generally, the invention relates to the field of sliding sports, on snow or water and relates more specifically to improvements of both the sliding board and the fastening device providing the link between the baseplate receiving the shoes and the board.

As a rule and conventionally, sliding boards or surfboards comprise a core generally made of wood or polyurethane equipped with at least one upper layer and one lower layer for reinforcement. These boards may be equipped with at least one strip or a rail anchoring and immobilizing the baseplates receiving the shoes in order to allow adjustment of the longitudinal position of each of the baseplates on the sliding board.

Each baseplate is designed to be adjustably and detachably mounted on the upper surface of the board and is provided with at least one locking component on the board.

Each baseplate delimits a recess in which a shoe is immobilized by means of holding and comprises central locking disc interacting, on the one hand, with the anchoring rail mounted on the board and supporting on the other hand components for preventing rotation, designed to prevent rotation of the baseplate in relation to the central disc and consequently rotation of the baseplate in relation to the board.

It is essential for the surfer to be able to adjust the distance between his/her legs and therefore adjust the longitudinal position of the baseplates on the board before using the board on snow or on water and moreover by translational displacement of the baseplate-central disc assembly in relation to the anchoring rail. Once longitudinal adjustment and its locking have been performed, it is subsequently essential, for safety reasons, to be able to guarantee prevention of translational movement of the baseplate, i.e. ensure that there will not be any unintended modifications of the adjustment.

In application FR 12 52863, the fastening device is adjustable and comprises a vertical pivot connected to the central locking disc by an axial threaded rod.

This pivot allows, temporarily, rotation of the baseplate in order to ensure adjustment, on the one hand, of the angular position of the shoes in relation to the longitudinal axis of the board and on the other hand, its longitudinal position on the board and consequently, of the distance between the surfer's feet on said board by adjustment of the longitudinal position of the two baseplates on the board in relation to one another.

In application FR 13 57369, the bottom section of the pivot is equipped with a rotary cam directly interacting with an anchoring strip.

DE 196 33 536 and U.S. Pat. No. 6,189,899 describe surfboards comprising an anchoring rail in the form of a metallic profile mounted on the board internally delimiting a groove for receiving a component for locking the baseplate which is partially closed, at its top edge and on either side, by longitudinal retaining shoulders.

The inside edge or the upper surface of these shoulders bears a series of notches interacting with rows of teeth mounted on the lower surface of the central locking disc of the binding baseplate in order to prevent its translational movement once the position on the board has been adjusted.

The two rows of teeth extend under the disc along two parallel and substantially diametral lines close to the center of the disc, adopting a position opposite and in contact with the notches on the anchoring rail.

Owing to execution of the teeth directly on the rail, this arrangement that weakens the shoulders carries risks of escapement of the anchoring component liable to result in breakage of the link between the baseplate and the board, which is unacceptable for the surfer's safety.

Furthermore, the dimensions of the teeth are necessarily limited, since the width of the rail must be sufficiently narrow to effectively trap the anchoring component and this compromise is detrimental to the effectiveness of the translational clamping of the baseplate.

What is more, the narrowness of the rail and the concomitant small spacing of the rows of teeth on the disc leaves a slight rotational play and instability of the baseplate on the board on either side of the central disc.

The present invention aims at solving these technical problems in a satisfactory and effective manner by proposing, by means of a simple arrangement, a sliding board which upper side is perfectly flush and an improved fastening device in which the anchoring function and the function of preventing translational movement of the baseplate are performed in a separate, optimized manner, in addition to a surfboard equipment comprising said sliding board and such a fastening device.

This aim is achieved, according to the invention, by means of a sliding hoard, the structure of which comprises at least one lower layer, at least one upper layer, a core, at least one rail delimiting a groove with top opening for receiving and guiding an anchoring component for a shoe fastening baseplate, wherein it comprises at least one serrated bar separate and spaced apart from the groove of the rail and designed to interact with at least one peripheral toothed sector mounted on the lower surface of the baseplate with, a view to preventing its longitudinal translational movement.

In a preferred embodiment, the distance between the axis of the rail and the edge of the bar is included between 20 mm and 40 mm.

According to an advantageous characteristic, the rail and the serrated bar are incorporated in cavities arranged in the thickness of the board.

The board is preferably designed so as the top opening of the groove and the serrated bar are flush with the upper surface of the board.

According to a preferred solution, the board comprises two serrated bars located equidistantly from said rail.

In a specific embodiment, each serrated bar is incorporated in the structure of the board through upper protective and reinforcing layers and in a sealed insert positioned in a cavity of the core.

According to other characteristics, an upper reinforcing and sealing layer is prolonged under the lower surface of said bar and the notches of said bar are oriented transversally and extend over its entire width.

The rail bears fastening fins sealed in the thickness of the board in contact with the core.

Another aim of the invention is a fastening device for a sliding board comprising a baseplate for receiving a shoe provided with a central opening receiving a locking disc operated by a pivot interacting with components for preventing rotation of the baseplate, wherein the lower surface of the disc bears at least one peripheral toothed sector designed to interact with a serrated bar incorporated in the sliding board in order to prevent longitudinal translational movement of the baseplate on said board.

According to an advantageous characteristic, said toothed sector is separate from the components for preventing rotation of the disc.

In a first solution, the components for preventing rotation of the disc are comprised of a castellated crown inside which said toothed sector extends.

Preferably, said castellated crown delimits the outer edge of the peripheral toothed sector, the inner edge of which is straight.

According to another characteristic, said peripheral toothed sector comprises at least one outer edge that extends over an angular area of the lower circumference of the disc.

In an alternative solution, the locking disc comprises a separate lower component inserted and installed coaxially under the baseplate, the lower circumference of which bears said toothed sector.

According to another characteristic, the width of a toothed sector is less than or equal to that of a serrated bar.

In a first alternative solution, the device comprises two diametrically opposed peripheral toothed sectors on the lower circumference of the disc, each interacting with one of the bars.

Said toothed sectors are executed in the form of orthoradial parallel strips.

In a second alternative solution, said toothed sectors are arranged in pairs on angular areas diametrically opposed on the circumference of the disc.

According to other characteristics, the height of the teeth of said toothed sector is less than or equal to the depth of the notches of said bar and, the profile of the teeth of the disc is substantially identical to that of the notches of said bar.

Yet another aim of the invention is a snowboard equipment comprising:

- a sliding board equipped with a central rail delimiting a groove with a top opening and at least one serrated bar separate and spaced apart from the groove of the rail and
- a fastening device comprising a baseplate for receiving a shoe provided with a central opening receiving a locking disc operated by a pivot interacting with components for preventing rotation of the baseplate, wherein the lower surface of the disc bears at least one peripheral toothed sector designed to interact with the serrated bar of the sliding board in order to prevent longitudinal translational movement of the baseplate on said board.

In a preferred embodiment of the equipment, said rail and said bar are incorporated flush in the thickness of the board.

The fastening device, as improved according to the invention, is incorporated both totally flush in the board and compactly in the baseplate, which makes it possible to offer surfers effective prevention of translational movement and a high degree of stability of the feet on a board, the upper surface of which is perfectly smooth and flat and without any change either in the weight or the volume of the baseplate.

The risks of butting against, catching and/or impact against a protruding section are thus eliminated, which avoids any risks of tearing away and damage to the board.

Furthermore, the means of preventing translational movement do not change or impair in any way the method of anchoring the baseplate in the board.

Thus, the device according to the invention remains compatible with two possible methods of anchoring (standard 4×4 with a screwed central crown or a central cam) and may therefore receive two types of baseplate for fastening a shoe.

This configuration makes the board equipped with the device according to the invention particularly visually appealing and easy to store or transport, since its upper surface is devoid of roughness.

Furthermore, use of the board according to the invention requires only minor adaptations to the baseplates, as only the locking disc needs to be replaced or supplemented with an insert.

The invention will be understood better from reading the following description, accompanied by the drawings explained hereafter.

FIG. 2B represents a bottom view of the baseplate equipped with its central disc according to a first embodiment and FIG. 2C represents a bottom view of the central disc alone, according to this first embodiment.

FIGS. 3A and 3B represent overall views, respectively in an exploded perspective and in longitudinal section along III-III of the baseplate and the board, in the assembled position a second embodiment of the fastening device according to the invention, whereas

Figure 1:
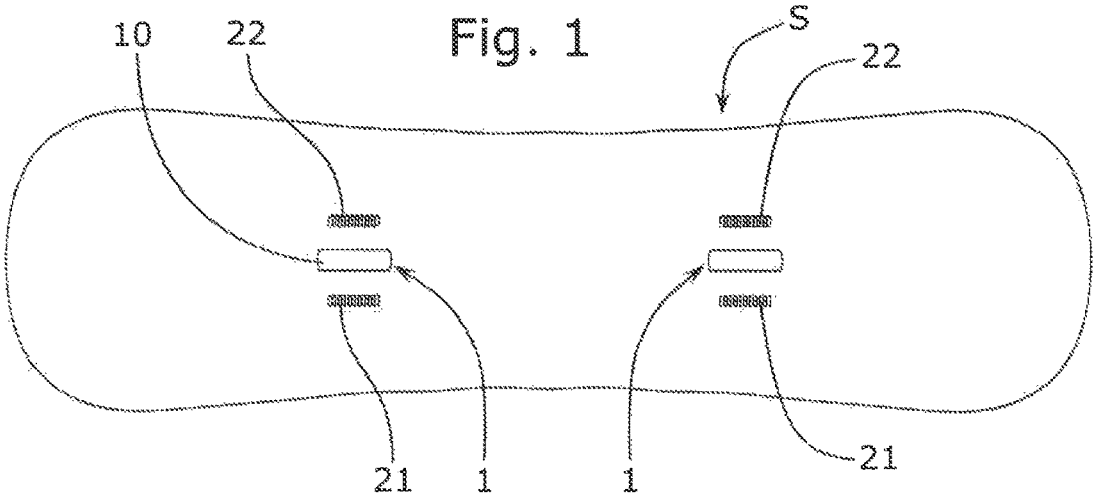
FIG. 1 represents a top view of a sliding board equipped with the fastening device according to the invention.
Figure 2A:
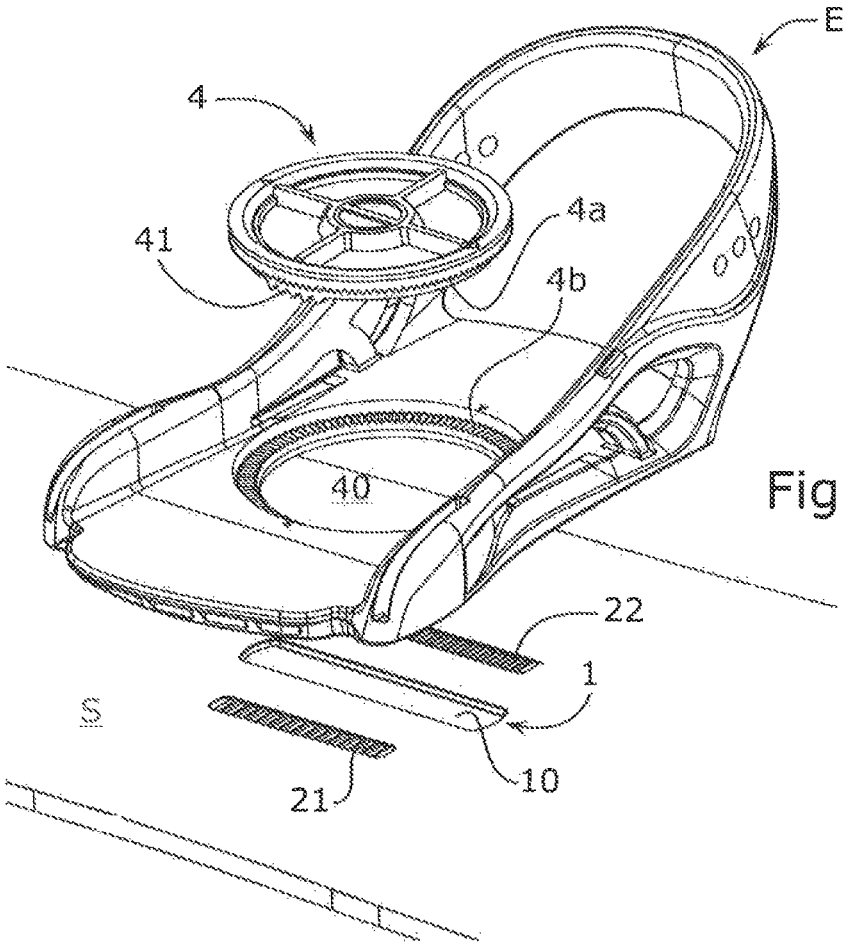
FIG. 2A represents an exploded perspective overall view of a first embodiment of the fastening device according to the invention.

The fastening device according to the invention, as illustrated in the figures, is designed to equip sliding boards such as a snowboard S (FIG. 1) in order to ensuring anchoring and reversible immobilization of baseplates E for receiving shoes, an embodiment of which is illustrated in FIG. 2A.

Each of these baseplates delimits an open housing in which a shoe or a boot (not illustrated) is designed to be immobilized by means of holding, not illustrated, which may for example be securing straps.

A fastening device of this kind generally comprises;

- on the one hand, a first set of parts assembled together on and around a baseplate E (wherein some are removable and replaceable in case of wear) and,
- on the other hand, a second set of parts incorporated in the board S.

For reasons of clarity, only the parts that directly concern the invention will subsequently be described in further detail.

Figure 3A:
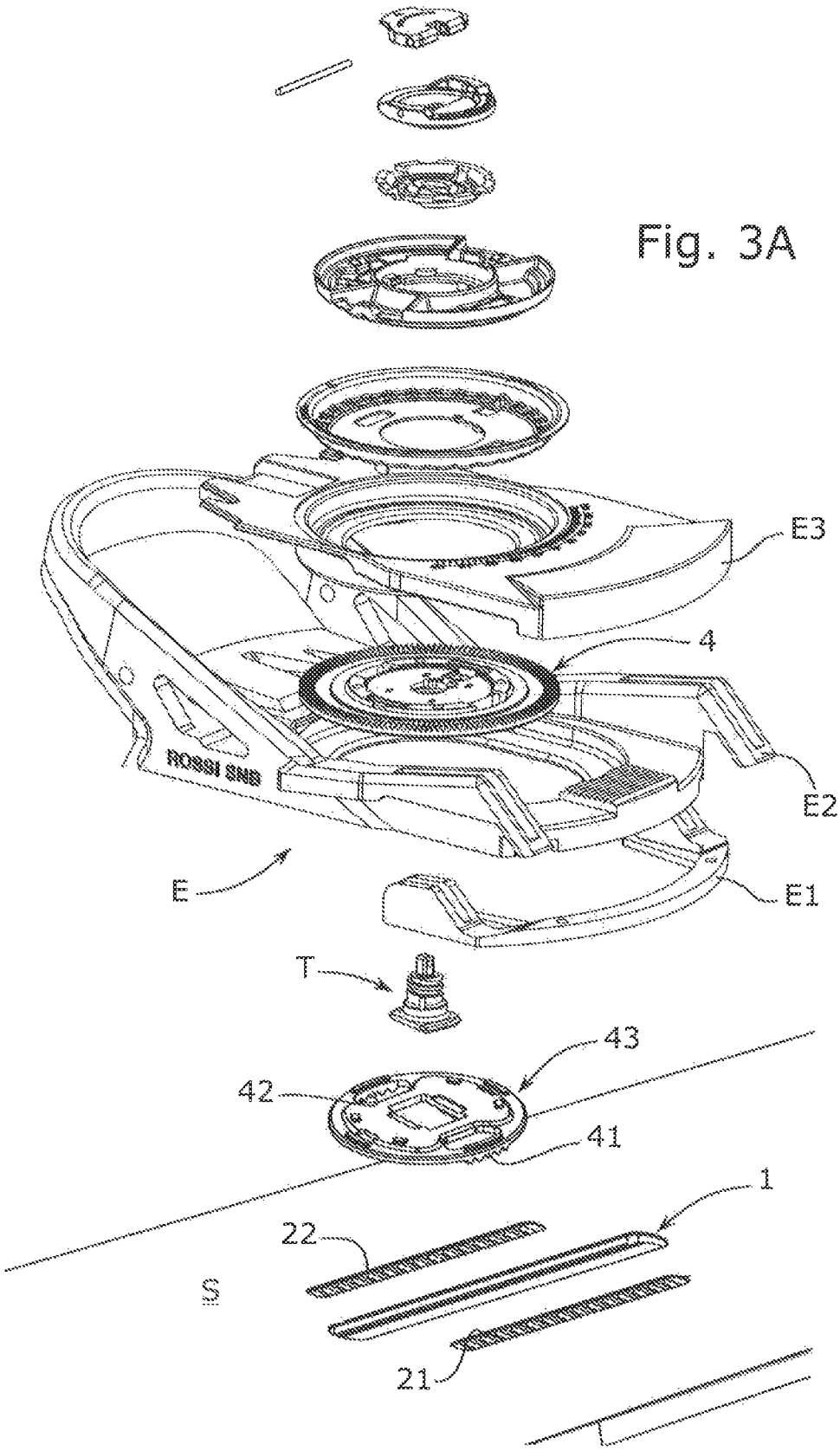

The first set of parts, illustrated in FIGS. 2A and 3A, is mounted on the baseplate E and provides the latter options for adjustment in, the angular position.

This set of parts essentially comprises an axial pivot operating a locking disc 4 (sometimes associated with one or several spacers) and an anchoring component T which comes, in the embodiment illustrated here (particularly by FIGS. 2B, 2C and 3B), in the form of a pivoting and retractable pin (with an inverted T shape) mounted on the bottom section of the central disc 4 in order to solidly attach the baseplate E to the baseplate S. Once engaged in the rail, this pin is capable of pivoting through 90 degrees in order to bring the baseplate and the disc into vertical retaining position.

In the embodiment in FIGS. 2A and 2B, the central locking disc 4 interacts by screw fitting with the anchoring component T in order to allow its rotation through 90 degrees. The disc 4 comprises components for preventing rotation in the form of castellated rings or crowns 4*a* executed under its lower surface and designed to interact with a second toothed crown 4*b* executed opposite on the baseplate E. Completely screwing the rotating upper ring of the disc 4 subsequently allows tightening of both crows against each other in order to prevent rotation of the baseplate E in relation to the central disc 4.

Furthermore, the sliding board S comprises rigid profile 1 (preferably made of aluminum) designed to establish the link with the baseplate E via the anchoring component T in order to allow fastening of the shoes.

Indeed, the anchoring component T is positioned in the profile or rail 1 before being rotated by a quarter of a turn in order to retain the disc 4 and the baseplate E vertically in relation to the board S.

Thus, the fins T1 and T2 (FIG. 2C) formed by the bar of the T are then positioned under the shoulders 11 of the anchoring rail 1 in order to retain the disc 4 vertically in relation to the board S.

Figure 4:
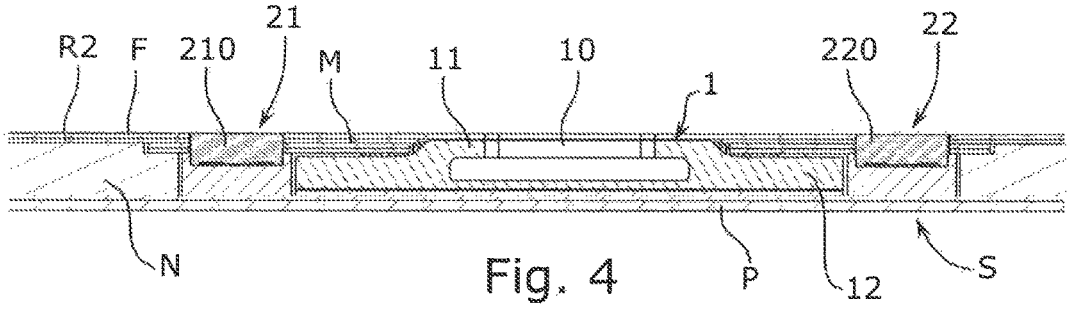
FIG. 4 represents a partial view in cross section of a first alternative embodiment of the board according to the invention.

This profile is intended to be integrally accommodated in the structure of the board, as illustrated in FIGS. 1 and 2A and as illustrated in detailed section in FIG. 4.

To this end, the profile 1 forms rail delimiting a groove 10 open on the top.

This groove extends in the longitudinal direction of the board and serves to receive and guide the anchoring component T mounted on the baseplate E. Indeed, the anchoring component T can be moved transitionally a long the rail 1 before being immobilized in the longitudinal position selected using the axial pivot allowing, complete locking of the disc 4 on the baseplate E.

The groove 10 is partially closed, at its upper edge and on either side, by straight longitudinal shoulders 11.

The shoulders 11 help to retain the anchoring component. T of the baseplate E in the rail 1.

The interaction between the groove 10 and the anchoring component T thus makes it possible, in a manner known per se, to fasten the surfer's feet solidly to the board in longitudinal positions capable of being adjusted beforehand at the locking mechanism of the baseplate E, with the distance between the feet being an important parameter to be configured by the surfer.

Furthermore, the surfer ran also select the angular position of each of the baseplates E in relation to the board S by unlocking the central locking pivot which enables release of the toothed crowns positioned on the disc 4 and on the periphery of the opening of the baseplate E.

Hence, completely locking the central pivot allows both rotational locking of the baseplate E in relation to the disc 4 and the board S and translational locking of the baseplate E on the board S.

This translational locking between the anchoring component T and the anchoring rail 1, which interact by friction may not be sufficient in order to maintain the selected translational position in a stable and sustainable manner, hence the need to add the fastening device according to the invention.

Indeed, when proceeding over the snow, the forces applied by the user to the baseplates for retaining his/her feet are very high and tend to change the initial longitudinal adjustment selected for each of the baseplates, which is unacceptable.

Hence the need for an additional system for preventing longitudinal translational movement.

Although the fastening device according to the invention is generally employed pairwise, wherein each device is associated with a single baseplate E (FIGS. 1, 2A, 3A), it would however be possible to provide, in an alternative embodiment not illustrated, for adaptation of this device (for example, by changing its geometry, but without necessarily changing its structure) so that it alone receives two baseplates.

For example, the board S could be equipped with a single rail of sufficient length to allow mounting of the two baseplates and four serrated bars would subsequently be arranged opposite each other in pairs on either side of this single rail.

In a preferred embodiment, the board S has two rails, wherein the opening of the groove 10 of each rail 1 generally has a length of between 90 mm and 180 mm and preferably of between 110 mm and 130 mm in order to avoid flexural stiffening of the board. Each of the rails 1 is in this case designed to receive a single baseplate E.

The width of the opening of the groove 10 of the rail is, for its part, included between 15 mm and 25 mm in order to ensure a good hold of the baseplate E.

As illustrated in FIG. 4, the profile 1 forming the rail is designed to be integrally accommodated in the thickness of the board such that the opening of the groove 10 extends substantially flush to the upper surface, which thus remains perfectly flat. More specifically, the opening of the groove may be located either on the upper surface of the board, or a few millimeters underneath in a case in which the shoulders 11 are covered, either partially or completely, by the upper protective layer F and/or by a reinforcing layer R2 (these different layers will be described below with reference to FIGS. 4, 5A and 5B).

In the embodiment illustrated, the profile 1 bears fastening fins 12 extending in the transversal direction of the board S and designed to be sealed in its thickness, thereby securing attachment of the anchoring rail to the internal structure of the board. S.

If appropriate, additional fins will also be provided at the longitudinal ends of the profile in order to reinforce the sealing, if necessary.

The fins 12 are executed in this case in one piece with the body of the profile 1 to which they are connected laterally and halfway up.

The invention aims to improve this fastening device by supplementing the anchoring and locking means previously described with specific means designed to reinforce translational locking of the baseplate E on the board S.

Once adjustment of the position and/or orientation of the baseplate E has been performed, the surfer proceeds to lock the latter by screwing the pivot 3 tight.

This screwing action results in wedging and immobilization of the anchoring component T in the rail 1.

Nevertheless, over time, slight play often develops between the baseplate and the board.

This play in fact tends to increase both with the distortion movements of the board S and with the vibrations generated by the sliding of the board, the jerks and major stresses applied by the user to the baseplates when using the board S on the snow, which may result in longitudinal offsetting of the position of the baseplate on the board.

In order to guarantee durability and reliability of the initial longitudinal adjustment, it is therefore necessary to ensure secure and sustainable prevention of longitudinal translational movement of the baseplate on the board.

With this aim, the invention makes provision for executing, on the one hand, at least one bar and in the form illustrated here, two serrated bars 21, 22 designed to be incorporated flush (or slightly depressed) in the board S and on the other hand, at least one toothed sector and in this case two peripheral toothed sectors 41, 42 mounted on the lower surface of the locking disc 4 of the baseplate E. Indeed, it is the disc 4 that has a fixed, predetermined position in relation to the board S, whereas the baseplate E can be rotationally mobile in relation to the board for as long as the central pivot is not locked.

In an alternative embodiment, a single serrated bar could be sufficient and could interact in this case with a single toothed sector mounted on the lower surface of the disc 4.

In another alternative embodiment, the device according to the invention could comprise more than two serrated bars per rail and more than two toothed sectors per disc.

For reasons related to effectiveness of mechanical strength, it is essential for the serrated bars 21, 22 to extend at a distance from the rail 1 and interact respectively, by engagement, with one of the two toothed sectors executed opposite on the lower surface of the disc 4.

The advantage, furthermore, of this arrangement is to provide greater stability of the baseplate E owing to the fact that the action of the central anchoring component T is enhanced by the lateral grip of the toothed sectors 41, 42 in the bars 21, 22 in the manner of pillars.

It is above all important that the serrated bars should be separate and spaced apart from the shoulders 11 of the rail 1 so as not to weaken the rail 1 and maintain sufficient resistance to tearing away of the anchoring component T.

Preferably, the distance between the axis of the rail 1 and the edge of the bars 21, 22 is greater than 20 mm or indeed preferably greater than 30 mm and in particular, between 30 and 40 mm.

Figure 3B:
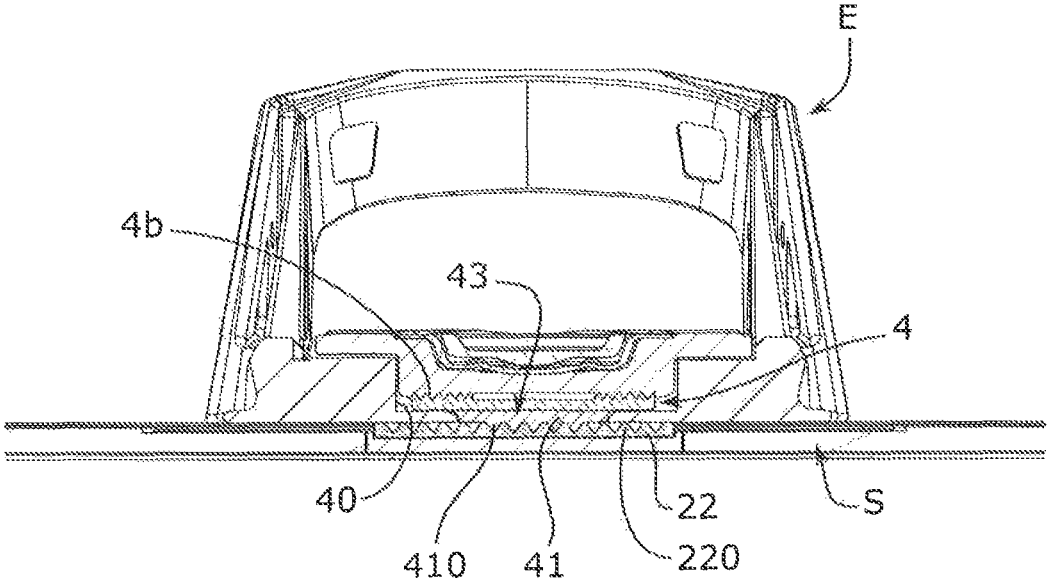

As illustrated by FIGS. 2A, 3A and 3B, the notches 210, 220 of the bars 21, 22 are oriented transversally and extend over the entire width of the bars.

The toothed sectors 41, 42 are, for their part, arranged on two diametrically opposed angular areas of the circumference of the disc.

In order to ensure easy, stable and resistant mutual engagement, the profiles of the teeth 410, 420 and of the notches 210, 220 are complementary.

Furthermore, it is provided for the maximum width of the sectors 41, 42 to be less than or equal to that of the bars 21, 22 and for the height of the teeth 410, 420 of these sectors to be less than or equal to the depth of the notches 210, 220 of these bars.

Under these conditions and following locking of the fastening device, the lower surface of the baseplate remains perfectly in supporting contact with the upper surface of the board.

Preferably, the width of the bars 21, 22 is between 5 and 15 mm and preferably between 9 and 11 mm and their height is between 3 and 5 mm whereas the depth of the notches 210, 220 (and therefore the maximum height of the teeth 410, 420) is between 3 and 4 mm.

The steps of the notches, i.e. the width of their bases, is between 4 and 6 mm and is preferably 5 mm.

The length of the bars 21, 22 will be closely similar to the length of the rail (to + or −20 mm) if the rail is intended to receive a single baseplate E in order to ensure an adequate adjustment range.

In the specific case illustrated in the second embodiment, the length of the bars 21, 22 is shorter than the length of the rail 1, given that the disc 4 comprises lateral stops 44*a*, 44*b*.

These stops ensure guidance in the groove of the rail 1 and participate in preventing rotational movement of the disc 4 in relation to the rail 1.

This configuration requires provision of a longer rail 1 in order to allow accommodation and movement of these stops 44*a*, 44*b*.

In an alternative embodiment of these lateral stops, the rail 1 and the bars 21, 22 would in this case be approximately of the same length.

The profile of the notches 210, 220 of the bars 21, 22 is symmetrical in order to facilitate adjustment by moving the disc 4 in both directions so that it is equally easy for the user to bring his/her feet together or move them apart.

Figure 5A:
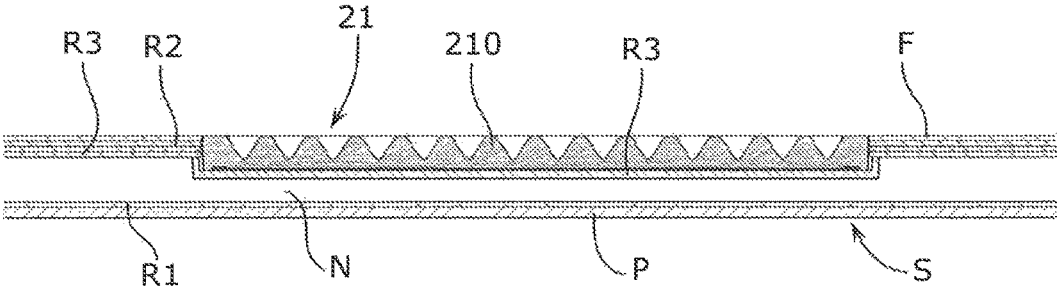
FIGS. 5A and 5B represent partial views in longitudinal section respectively according to the first alternative embodiment corresponding to FIG. 4 and of another alternative embodiment of the board according to the invention.
Figure 5B:
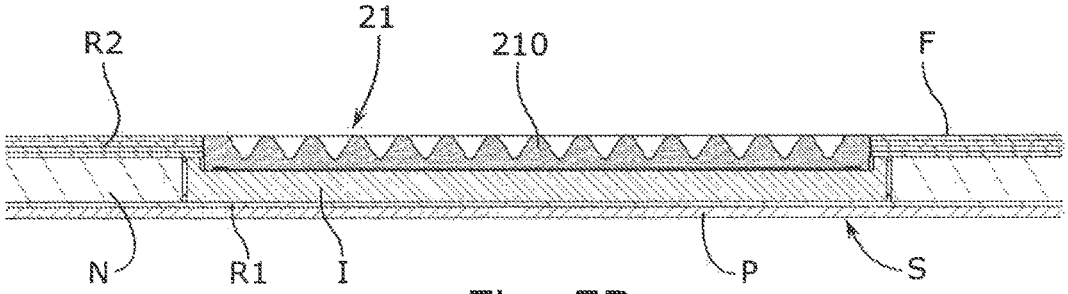

Preferably, this profile is substantially identical to that of the teeth 410, 420 of the sectors 41, 42; whereby the ends of the notches (and of the teeth) are rounded if necessary to make them less aggressive and less subject to wear, as illustrated in FIGS. 5A and 5B.

Finally, the material of which the bars is made will be selected for its rigidity, its lightness and its compatibility with the different layers of the board, but also for its good contact properties in interacting with the teeth of the sectors of the disc 4.

A plastic material of the polyamide or polyurethane type, possibly reinforced with composite fibers or even a metallic material may thus advantageously be used.

In the embodiment illustrated in FIG. 2A, the disc 4 is in one piece and the toothed sectors 41, 42 are arranged directly on its lower surface.

This disc 4 is itself installed in a hollowed out recess 40 arranged on the upper surface of the baseplate E, the circumference of which is delimited by the castellated crown 4*b* such that the teeth 410, 420 protrude downwards in the direction of the bars 21, 22.

As illustrated by FIGS. 2B and 2C and still in this same embodiment, the toothed sectors 41, 42 are executed in the form of strips, of which the outer edge 41*a*, 42*a* follows the circumference of the disc 4, whereas the inner edge 41*b*, 42*b* extends orthoradially, i.e. perpendicularly to a diameter of this disc, wherein this inner edge is straight and the edges 41*b* and 42*b* are parallel to one another.

According to an alternative embodiment, not shown, the toothed sectors are executed in the form of two orthoradial strips, the outer and inner edges of which are parallel, the spacing of which on the disc in relation to the center of the disc is preferably as wide as possible.

Figure 3C:
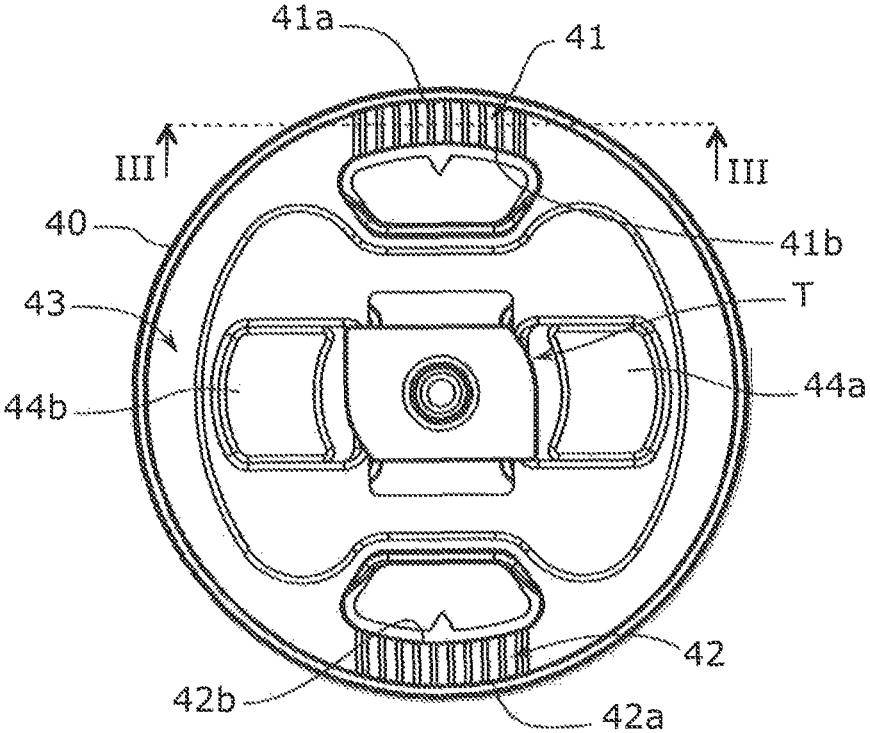
FIG. 3C represents a partial top view of the locking disc according to this same embodiment.

In the embodiment illustrated in FIGS. 3A, 3B and 3C, the locking disc 4 comprises a separate cylindrical component 43 on which the toothed sectors 41, 42 are mounted, which is inserted, installed coaxially under the disc 4 and fixed to the latter by screw-type attachment means.

FIG. 3A represents a baseplate E formed of several parts E1, E2 and E3 assembled together and trapping the disc 4. This baseplate is furthermore provided with an axial pivot consisting in turn of several elements, including the lower anchoring component T and cylindrical components mounted on top of the baseplate.

Hence, there will be no departure from the framework of the invention if the baseplate is of varying shapes and if they are formed of several juxtaposed and/or superimposed parts.

In an alternative embodiment applied in this case to insert 43, the inner edge 41*b*, 42*b* of the toothed sectors 41, 42 follows the circular circumference of the outer edge 41*a*, 42*a* over an angular length of between 20 and 40°, preferably 35°, as illustrated by FIG. 3B.

It would also be possible however without departing from the framework of the invention to execute the toothed sectors according to the alternative embodiments described above by reference to FIGS. 2B and 2C.

The board according to the invention, which comprises incorporation of various different constituent components of the fastening device according to the invention is described below.

At least one rigid profile 1, forming a rail and as illustrated here and two profiles of the type described above are incorporated in the structure of the board S.

This profile is produced, preferably, by machining or by drawing or even by extrusion of a light metal (aluminum . . . ) part, or by molding a possibly reinforced plastic part.

It features a parallelepipedal section, open, partially, on its upper surface delimiting a groove 10 forming a slide for the anchoring component T of the baseplate E. This groove can be executed either before molding of the board S or can be machined after molding of the board S.

Conventionally and in the form illustrated, this profile 1 is advantageously provided with lateral fins 12 in order to increase the resistance of the rail 1 to tearing away.

The two serrated rigid bars 21, 22 of the type described above with an appropriate rigid material will also be incorporated in the structure of the board S. The notches may be created either before molding, or by machining of the bars after molding of the board S.

According to an alternative embodiment of the method, it would be possible to execute the rail profile and the bars in one piece made of the same rigid material having the required mechanical properties, wherein the bars are executed in this case beyond the shoulder areas 11 of the rail 1.

A surfboard is generally manufactured by hot-molding. All its constituent components (sole, edges, edging, upper and lower lock reinforcing layers and wooden or polyurethane core, . . . ) are prepared before molding. The different layers of material are pre-cut.

The core of the board, particularly if the latter made of wood, is also pre-cut and its thickness is adapted to the thickness curve of the board S.

The different layers of material are subsequently stacked in a mold, the profile of which is adapted to the shape and dimensions of the desired surfboard.

The composite material reinforcing layers are pre-glued with a resin.

During molding, the assembly is applied by compression around the core and is heated to a high temperature. The resin that polymerizes thus creates cohesion among the different components.

After demolding, the board undergoes a finishing operation, involving in particular removal of the excess material all around the perimeter.

In the method according to the invention, provision is made for creating, in the wooden (or polyurethane) core N of the board and prior to molding, a central cavity opening out on the upper surface in addition, to at least two lateral cavities extending equidistantly and parallel to the central cavity (FIG. 4).

These cavities, which are produced by cutting the core N or removing material, have profiles and dimensions allowing installation of the bars 21, 22 and of the profile 1 such that its fine 12 are in contact with the core N and its shoulders 11 extend substantially flush to the upper surface of the board and likewise the upper ends of the notches 210, 220 of the bars 21, 22.

Since the bars are designed to be incorporated in the thickness of the board and their height is such that they penetrate into the core, the structure of the board must be suitable in order to ensure their mechanical strength without compromising its seal in the implantation area.

Hence, the structure of the board S is modified in the implantation area of the bars 21, 22.

A first structure of the board is illustrated in FIGS. 4 and 5B. In this alternative embodiment, the core N is interrupted in the area of the bar 21, 22 and features two cavities in which inserts made of ABS-type plastic are positioned, which in turn have recess for receiving each of the bars 21, 22. Use of this plastic insert I seals the structure of the board S around the lower parts and the lateral sides of the bars, whereas the wooden core could not have guaranteed this seal.

Other sealing means could of course have been used, the aim being to ensure that no water seeps between the bar and the structure of the board.

On the upper sides of the bars, sealing is provided by the reinforcements R2 and upper protective layer F which come into contact with these sides.

Furthermore, the lower reinforcement R1 covers the lower surfaces of the core N and of the insert I.

In the area of the rail 1, the upper layers of fibrous material R2 and M trap the fins 12 of the profile 1 while reinforcing its resistance to tearing away.

In a manner known per se, the upper reinforcing layer R1 and lower reinforcing layer R2 are executed either using a composite fibrous material (fiberglass fabric, for example, coated with an epoxy-type polymer resin), or in aluminum, whereas the protective layer F is produced using a transparent material and is possibly provided with a graphic decor.

In a manner known per se, underneath the lower reinforcement, a sole P is positioned, the lateral sides of which are bordered by edges (not illustrated).

In a known fashion, the method of manufacture by molding causes, during hot polymerization of the resin, stratification of the fibrous layers and subsequently binding and joining of the different constituent components of the board and of the incorporated fastening device.

In another alternative embodiment illustrated in FIG. 5A, the core N is not completely interrupted as in the previous alternative embodiment and instead is simply hollowed out sufficiently in order to receive, in the recesses, not only the bars 21, 22 but also at least one reinforcing layer R3 comprised for example, of fibers encased in resin and positioned underneath the bars 21, 22, thereby jointly providing sealing between the bars and the core N.

The board illustrated here features two central rails aligned along the longitudinal axis of the board and each designed to receive a baseplate E.

There will be no departure from the framework of the invention if these two rails join together to form a single longer central rail, designed to receive both baseplates.

Jointly and in order to make the board compatible with the fastening device according to the invention, it is necessary to modify the conventional baseplate and more specifically, the central locking disc such that the lower surface bears at least two peripheral toothed sectors designed to interact with the notched bars already incorporated in the board.

For this purpose, it is merely necessary either to replace the conventional locking disc with a modified disc of the same diameter, but the lower surface of which bears toothed sectors suitable for interacting with the notched bars, or add to the disc a cylindrical component such as component 43 (FIG. 3A) with toothed sectors, executed separately and subsequently inserted and installed coaxially under the baseplate.

The invention has been more specifically described in an application to a sliding board, but could be reproduced in a similar manner in order to be used in relation with an aquatic sliding board.

The invention claimed is:

1. Sliding board, the structure of which comprises at least one lower layer, at least one upper layer, a core, at least one rail delimiting a groove with a top opening for receiving and guiding an anchoring component for a shoe fastening baseplate, wherein at least one serrated bar separate and spaced apart from the groove of the rail interacts with at least one peripheral toothed sector mounted on the lower surface of the baseplate with a view to preventing a longitudinal translational movement of said baseplate.

2. Sliding board according to claim 1, wherein the distance between the axis of the rail and the edge of the serrated bar is included between 20 mm and 40 mm.

3. Sliding board according to claim 2, wherein the rail and the serrated bar are incorporated in cavities arranged in the thickness of the board.

4. Sliding board according to claim 1, wherein the rail and the serrated bar are incorporated in cavities arranged in the thickness of the board.

5. Sliding board according to claim 4, wherein the top opening of the groove and the serrated bar are flush with the upper surface of the board.

6. Sliding board according to claim 1, wherein two serrated bars are located equidistantly from said rail.

7. Sliding board according to claim 1, wherein each serrated bar is incorporated in the structure of the board through upper protective and reinforcing layers and in a sealed insert positioned in a cavity of the core.

8. Sliding board according to claim 1, wherein an upper reinforcing and sealing layer is prolonged under the lower surface of said serrated bar.

9. Sliding board according to claim 1, wherein said serrated bar includes notches oriented transversally and extending over the entire width of said serrated bar.

10. Sliding board according to claim 1, wherein the rail bears fastening fins sealed in the thickness of the board in contact with the core.

11. Fastening device for a sliding board comprising a baseplate for receiving a shoe provided with a central opening receiving a locking disc operated by a pivot interacting with components for preventing rotation of the baseplate, wherein the lower surface of the disc bears at least one peripheral toothed sector designed to interact with a serrated bar incorporated in the sliding board in order to prevent longitudinal translational movement of the baseplate on said board.

12. Fastening device according to claim 11, wherein said toothed sector is separate from the components for preventing rotation of the disc.

13. Fastening device according to claim 11, wherein the components for preventing rotation of the disc are comprised of a castellated crown inside which said toothed sector extends.

14. Fastening device according to claim 13, wherein said castellated crown delimits the outer edge of the peripheral toothed sector, the inner edge of which is straight.

15. Fastening device according to claim 11, wherein said peripheral toothed sector comprises at least one outer edge that extends over an angular area of the lower circumference of the disc.

16. Fastening device according to claim 11, wherein the locking disc comprises a separate lower component inserted and installed coaxially under the baseplate, the lower circumference of which bears said toothed sector.

17. Fastening device according to claim 11, wherein the width of a toothed sector is less than or equal to that of a serrated bar.

18. Fastening device according to claim 11, wherein it comprises two diametrically opposed peripheral toothed sectors on the lower circumference of the disc, each interacting with one of the bars.

19. Fastening device according to claim 18, wherein said toothed sectors are executed in the form of orthoradial parallel strips.

20. Fastening device according to claim 18, wherein said toothed sectors are arranged in pairs on angular areas diametrically opposed on the circumference of the disc.

21. Fastening device according to claim 11, wherein the height of the teeth of said toothed sector is less than or equal to the depth of the notches of said bar.

22. Fastening device according to claim 11, wherein the profile of the teeth of the disc is substantially identical to that of the notches of said bar.

23. Snowboard equipment comprising:

a sliding board equipped with a central rail delimiting a groove with a top opening and at least one serrated bar separate and spaced apart from the groove of the rail and a fastening device comprising a baseplate for receiving a shoe provided with a central opening receiving a locking disc operated by a pivot interacting with components for preventing rotation of the baseplate, wherein the lower surface of the disc bears at least one peripheral toothed sector designed to interact with the serrated bar of the sliding board in order to prevent longitudinal translational movement of the baseplate on said board.

24. Snowboard equipment according to claim 23, wherein said rail and said bar are incorporated flush in the thickness of the board.

* * * * *